US009535398B2

(12) United States Patent
Yada et al.

(10) Patent No.: US 9,535,398 B2
(45) Date of Patent: Jan. 3, 2017

(54) DEVELOPER CARTRIDGE, DEVELOPING APPARATUS, PROCESS CARTRIDGE AND IMAGE FORMING APPARATUS

(71) Applicant: CANON KABUSHIKI KAISHA, Tokyo (JP)

(72) Inventors: Takayuki Yada, Suntou-gun (JP); Toru Oguma, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/842,952

(22) Filed: Sep. 2, 2015

(65) Prior Publication Data

US 2016/0070207 A1 Mar. 10, 2016

(30) Foreign Application Priority Data

Sep. 4, 2014 (JP) ..... 2014-179994
Aug. 17, 2015 (JP) ..... 2015-160538

(51) Int. Cl.
*G03G 15/08* (2006.01)
*G03G 21/18* (2006.01)

(52) U.S. Cl.
CPC ..... *G03G 21/186* (2013.01); *G03G 15/0891* (2013.01)

(58) Field of Classification Search
CPC ..... G03G 15/0887; G03G 15/0889; G03G 15/0891; G03G 21/1857; G03G 21/186; F16H 57/0018; F16H 57/0025
USPC ..... 399/119, 254, 256
See application file for complete search history.

(56) References Cited

U.S. PATENT DOCUMENTS 3,552,804 A * 1/1971 Bracken ..... 384/99
5,455,665 A 10/1995 Baba et al.
5,768,658 A 6/1998 Watanabe et al.
5,790,923 A 8/1998 Oguma et al.
5,812,909 A 9/1998 Oguma et al.
6,088,556 A * 7/2000 Nagasaki et al. ..... 399/120
6,097,909 A 8/2000 Watanabe et al.
6,144,821 A 11/2000 Oguma
6,173,130 B1 1/2001 Oguma
6,266,500 B1 7/2001 Numagami et al.
6,272,299 B1 8/2001 Numagami et al.
6,377,759 B1 4/2002 Abe et al.
6,512,895 B2 1/2003 Sakurai et al.
6,571,070 B2 5/2003 Oguma et al.
6,587,650 B2 7/2003 Yokoi et al.
6,594,454 B2 7/2003 Oguma et al.
6,625,413 B2 9/2003 Oguma et al.
6,658,224 B2 12/2003 Yokoi et al.
6,671,477 B2 12/2003 Komatsu et al.
(Continued)

FOREIGN PATENT DOCUMENTS

JP 2002-162149 A 6/2002
JP 2003-162149 A 6/2003

*Primary Examiner* — Benjamin Schmitt
(74) *Attorney, Agent, or Firm* — Fitzpatrick, Cella, Harper & Scinto

(57) ABSTRACT

A developer container includes: a developer accommodating container for accommodating developer; a feeding member for feeding the developer, the feeding member being rotatable about an axis of a feeding shaft inside the developer accommodating container; and a drive transmission member rotatably mounted to the developer accommodating portion. The feeding shaft and the drive transmission member are bonded to each other at an engaging portion.

18 Claims, 7 Drawing Sheets

(56) References Cited

U.S. PATENT DOCUMENTS

| | | | | |
|---|---|---|---|---|
| 6,684,040 | B2 | 1/2004 | Yokoi et al. | |
| 6,704,525 | B2 | 3/2004 | Oguma et al. | |
| 6,735,405 | B2 | 5/2004 | Yokoi et al. | |
| 6,804,475 | B2 | 10/2004 | Oguma et al. | |
| 6,804,476 | B2 | 10/2004 | Yokoi et al. | |
| 6,804,483 | B2 | 10/2004 | Yokoi et al. | |
| 6,832,057 | B2 | 12/2004 | Oguma et al. | |
| 6,859,627 | B2 | 2/2005 | Karakama et al. | |
| 6,868,243 | B2 | 3/2005 | Watanabe et al. | |
| 6,892,035 | B2 | 5/2005 | Matsumoto et al. | |
| 6,952,544 | B2 | 10/2005 | Kikuchi et al. | |
| 6,993,264 | B2 | 1/2006 | Oguma et al. | |
| 7,024,131 | B2 | 4/2006 | Komatsu et al. | |
| 7,062,192 | B2 | 6/2006 | Oguma et al. | |
| 7,073,251 | B2 | 7/2006 | Kikuchi et al. | |
| 7,095,967 | B2 | 8/2006 | Karakama et al. | |
| 7,162,176 | B2 | 1/2007 | Oguma et al. | |
| 7,239,823 | B2 | 7/2007 | Oguma et al. | |
| 7,296,341 | B2 | 11/2007 | Kikuchi et al. | |
| 7,315,706 | B2 | 1/2008 | Oguma et al. | |
| 7,450,887 | B2 * | 11/2008 | Kim et al. | 399/167 |
| 7,865,115 | B2 | 1/2011 | Oguma et al. | |
| 8,571,445 | B2 | 10/2013 | Komatsu et al. | |
| 8,942,592 | B2 | 1/2015 | Uratani et al. | |
| 2005/0089338 | A1 * | 4/2005 | Hoshi | G03G 15/0891 399/27 |
| 2007/0189811 | A1 * | 8/2007 | Sato | 399/254 |
| 2010/0310275 | A1 * | 12/2010 | Hirota | 399/254 |
| 2013/0129377 | A1 * | 5/2013 | Satomura et al. | 399/106 |
| 2014/0112685 | A1 | 4/2014 | Komatsu et al. | |
| 2014/0286697 | A1 * | 9/2014 | Takeuchi | B29C 65/08 403/270 |

* cited by examiner

DEVELOPER CARTRIDGE, DEVELOPING APPARATUS, PROCESS CARTRIDGE AND IMAGE FORMING APPARATUS

FIELD OF THE INVENTION AND RELATED ART

The present invention relates to a developing container for use with an image forming apparatus, a developing apparatus, a process cartridge and the image forming apparatus.

Here, the image forming apparatus is an apparatus for forming an image on a recording material by using an image forming process of each of known various image forming principles or types, such as an electrophotographic process, an electrostatic recording process and magnetic recording process. Examples of the image forming apparatus may include a copying machine, a printer (LED printer, laser printer or the like), a facsimile apparatus, a word processor, and an image display apparatus (electronic blackboard or electronic white board).

The recording material is a material on which the image is to be formed, and includes, e.g., paper (sheet), an OHT sheet, a secondary transfer member, photosensitive paper, electrostatic recording paper.

Developer (toner) is magnetic or non-magnetic fine power, for visualization, used for developing a latent image by being deposited on the latent image formed on an image bearing member. In addition to a chromatic color developer, those of white and transparent are included in the developer.

As the developer container, it is possible to cite a container (supply developer container) accommodating the developer to be supplied to the developing device for developing the latent image by supplying the developer to the image bearing member on which the latent image is formed.

Examples of the image bearing member may include an electrophotographic photosensitive member in the electrophotographic process, an electrostatic recording dielectric member in the electrostatic recording process, a magnetic recording (magnetic) material in the magnetic recording process, and members capable of forming images through formation of a latent image by other various image forming principles or types. The image forming process means is an image forming process device for forming the image by acting on the image bearing member.

A cartridge is prepared by integrally assembling an image bearing member on which an image is to be formed and a part or all of image forming process means actable on the image bearing member, into a unit. Then, the cartridge is detachably mounted into an apparatus main assembly of the image forming apparatus and contributes to the image forming process for forming the image on the recording material. Examples of the cartridge may include a process cartridge, a developing cartridge and a developer cartridge. The apparatus main assembly of the image forming apparatus is an image forming apparatus constituent portion excluding the cartridge in the image forming apparatus of a cartridge type.

In the following, for convenience, description will be made by taking an electrophotographic image forming apparatus of Japanese Laid-Open Patent Application (JP-A) 2003-162149 as an example. In the electrophotographic image forming apparatus, to an electrophotographic photosensitive drum as an image bearing member on which a latent image is formed, the developer (toner) is supplied by the developing device, so that the latent image is developed into a developer image (toner image). The developer supplied to the developing device is accommodated in the developer container. The developer in the developer container is fed to the developing device while being stirred by driving a feeding member provided in the developer accommodating portion of the developer container.

The drive of the feeding member is made by inputting a driving force into a feeding driving shaft as a drive transmission member engaged with the feeding member. When the feeding driving shaft and the feeding member are engaged with each other, the developer container is provided with an opening through which the feeding driving shaft is passed and engaged with the feeding member, so that the driving force is transmitted to the feeding member via the feeding driving shaft.

An engaging portion of the feeding member with the feeding driving shaft is provided with a hole in which a shaft portion of the feeding driving shaft is engaged. The hole of the feeding member includes a lateral hole, and a claw portion provided on the feeding driving shaft enters the latent hole in an elastically deformed state, so that when the feeding driving shaft is engaged in the hole of the feeding member, the feeding driving shaft is prevented from dropping from the feeding member.

However, in the above-described conventional example, the following problem occurred. For example, when a process cartridge or a developing cartridge in which the developer container accommodating the developer is incorporated is transported, the developer accommodated in the developer container agglomerates around the feeding member due to shock or vibration in some cases. A similar phenomenon occurs also when the developer container accommodating the developer is transported as the developer container.

When the feeding driving shaft is rotated by initial drive of the process cartridge, the developing cartridge or the developer container, due to the developer agglomerating around the feeding member, a load exerted on the feeding member increases.

The feeding member and the feeding driving shaft are engaged with each other by engaging the shaft portion of the feeding driving shaft into the hole of the feeding member, so that a gap generates in a radial direction between the hole and the shaft. Further, at an engaging portion between the feeding driving shaft and the feeding member generate a gap in the radial direction, and therefore the feeding driving shaft and the feeding member are relatively inclined, so that the driving force is transmitted at a single point of the engaging portion and thus there was a liability that stress exerted on the engaging portion concentrated at the point.

Therefore, strength was conventionally increased by thickening or changing a material for the feeding driving shaft and the feeding member. However, in such a method, stress concentration at the engaging portion was not prevented sufficiently.

SUMMARY OF THE INVENTION

The present invention is a further development of the above-described conventional constitution.

A principal object of the present invention is to provide a developer container capable of reducing a degree of stress concentration at a connecting portion between a feeding member and a drive transmission member.

Another object of the present invention is to provide a developing device including the developer container.

Another object of the present invention is to provide a process cartridge including the developer container.

A further object of the present invention is to provide an image forming apparatus using the developer container or the process cartridge.

According to an aspect of the present invention, there is provided a developer container comprising: a developer accommodating container for accommodating developer; a feeding member for feeding the developer, the feeding member being rotatable about an axis of a feeding shaft inside the developer accommodating container; and a drive transmission member rotatably mounted to the developer accommodating portion, wherein the feeding shaft and the drive transmission member are bonded to each other at an engaging portion.

According to another aspect of the present invention, there is provided a developing apparatus for developing with developer a latent image formed on an image bearing member, comprising: a developing device including a developer carrying member for carrying the developer and for developing the latent image formed on the image bearing member; and a container for supplying the developer to the developing device, wherein the container is a developer container comprising, a developer accommodating container for accommodating developer, a feeding member for feeding the developer, the feeding member being rotatable about an axis of a feeding shaft inside the developer accommodating container; and a drive transmission member rotatably mounted to the developer accommodating portion, wherein the feeding shaft and the drive transmission member are bonded to each other at an engaging portion.

According to another aspect of the present invention, there is provided a process cartridge detachably mountable to a main assembly of an image forming apparatus, comprising at least: a rotatable image bearing member on which a latent image is formed; a developing device including a developer carrying member for carrying developer and for developing the latent image formed on the image bearing member; and a container for supplying the developer to the developing device, wherein the container is a developer container comprising, a developer accommodating container for accommodating developer, a feeding member for feeding the developer, the feeding member being rotatable about an axis of a feeding shaft inside the developer accommodating container; and a drive transmission member rotatably mounted to the developer accommodating portion, wherein the feeding shaft and the drive transmission member are bonded to each other at an engaging portion.

According to a further aspect of the present invention, there is provided an image forming apparatus for forming an image on a recording material, comprising: a rotatable image bearing member on which a latent image is formed; a developing device including a developer carrying member for carrying developer and for developing the latent image formed on the image bearing member; and a container for supplying the developer to the developing device, wherein the container is a developer container comprising, a developer accommodating container for accommodating developer, a feeding member for feeding the developer, the feeding member being rotatable about an axis of a feeding shaft inside the developer accommodating container; and a drive transmission member rotatably mounted to the developer accommodating portion, wherein the feeding shaft and the drive transmission member are bonded to each other at an engaging portion.

These and other objects, features and advantages of the present invention will become more apparent upon a consideration of the following description of the preferred embodiments of the present invention taken in conjunction with the accompanying drawings.

DESCRIPTION OF THE EMBODIMENTS

Embodiments of the present invention will be described in detail with reference to the drawings. However, the scope of the present invention is not intended to be limited to functions, materials, shapes, relative arrangement and the like of constituent elements described in the following embodiments unless otherwise specified.

In the following description, a rotational axis direction. Further, with respect to the longitudinal direction, a direction in which the electrophotographic photosensitive drum 62 receives a driving force from an apparatus main assembly A of an image forming apparatus 100 is a driving (side), and an opposite direction thereof is a non-driving (side) direction.

Embodiment 1

General Structure of Electrophotographic Image Forming Apparatus

Figure 2:
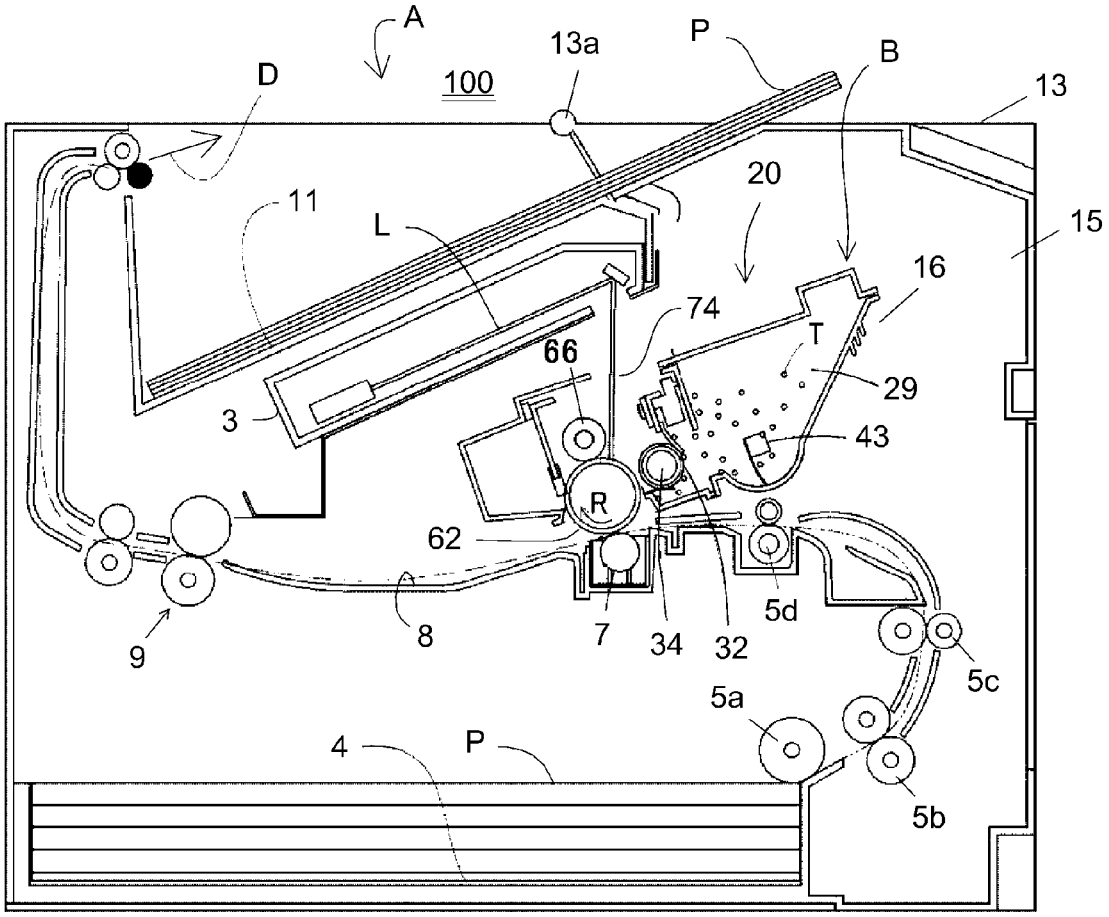
FIG. 2 is a schematic sectional view of an electrophotographic image forming apparatus in Embodiment 1.

A general structure of the electrophotographic image forming apparatus 100 in this embodiment will be described using FIG. 2. FIG. 2 is a schematic sectional view of the electrophotographic image forming apparatus 100 in which a process cartridge B is mounted in the apparatus main assembly A. This image forming apparatus 100 is a laser beam printer in which the process cartridge B is detachably mountable to the apparatus main assembly A and which uses electrophotographic technology.

When the process cartridge B is mounted in the apparatus main assembly A, above the cartridge B, an exposure device (laser scanner unit) 3 is provided. Further, below the cartridge B, a sheet (feeding) tray 4 in which a recording material (sheet material) P to be subjected to image formation is accommodated is provided.

Further, in the apparatus main assembly A, along a feeding direction D of the sheet material P, a transfer roller 7, a feeding guide 8, a fixing device 9, a discharge tray 11 and the like are successively provided.

General Structure of Process Cartridge

Figure 4:
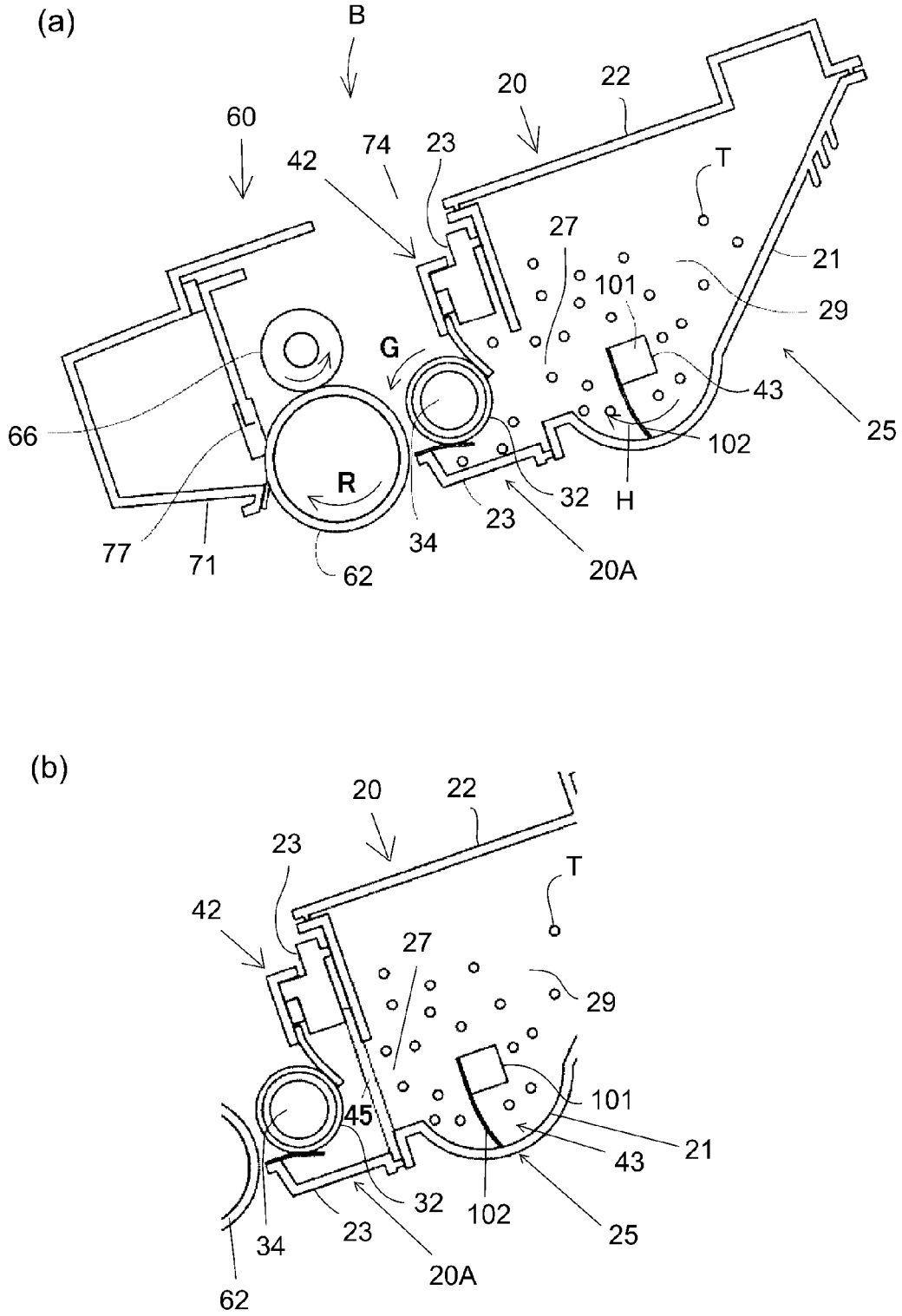
In FIG. 4, (a) and (b) are schematic sectional views showing a structure of the process cartridge.

In FIG. 4, (a) and (b) are enlarged sectional views of the cartridge B. This cartridge B is so-called process cartridge of an integral type constituted by integrally assembling a cleaning unit 60 and a developing apparatus (developing apparatus unit) 20 into a unit.

The cleaning unit 60 includes a cleaning frame 71, the electrophotographic photosensitive drum 62 as the image bearing member, a charging roller 66, a cleaning blade 77 and the like.

Figure 5:
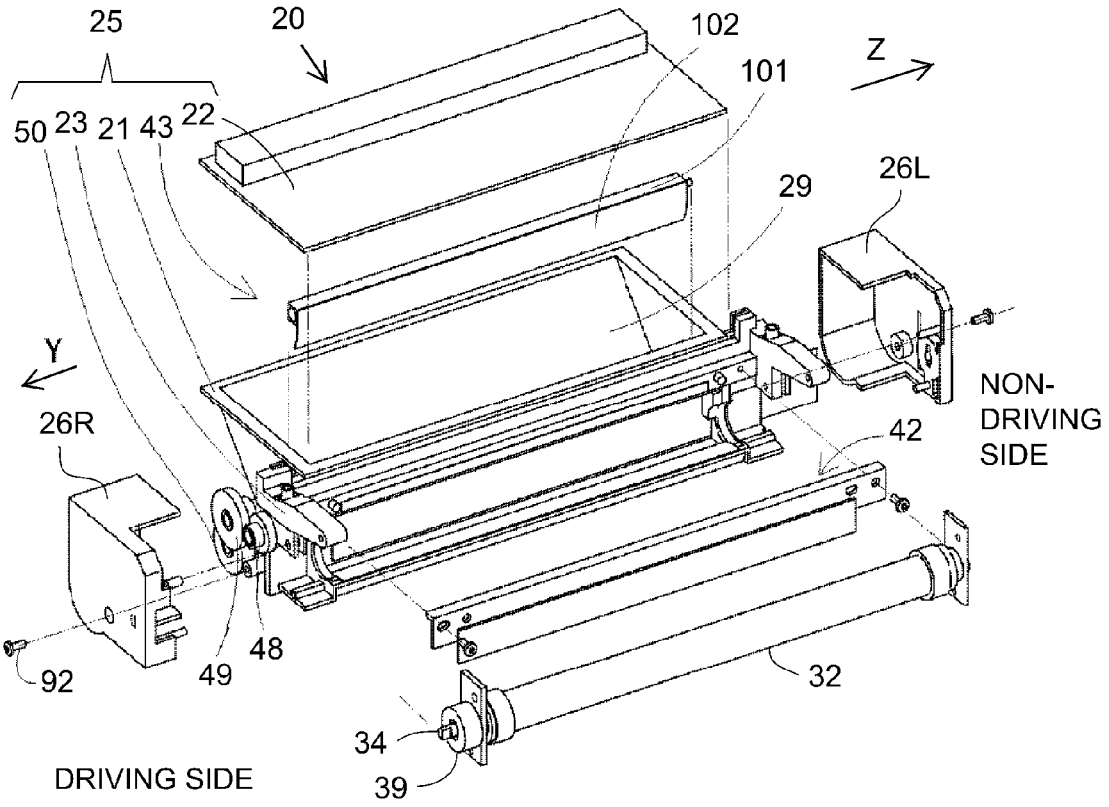
FIG. 5 is an exploded perspective view for illustrating a structure of a developing device.

The developing apparatus 20 is an apparatus in which an electrostatic latent image is developed into a toner image formed on the drum 62 by supplying a developer (one-component magnetic developer in this embodiment, hereinafter referred to as a toner) T to the drum 62. The structure of the developing apparatus 20 will be described using FIGS. 4 and 5. FIG. 5 is an exploded perspective view for illustrating the structure of the developing apparatus unit (developing apparatus) 20.

The developing apparatus 20 in this embodiment is an assembly of a developing device 20A, a developer container 25, a first side member 26L, a second side member 26R and the like.

The developing device 20A includes a developing container 23, a developing roller 32 as a developer carrying member for developing the latent image formed on the drum 62 by supplying the toner T to the drum 62, a magnet roller 34, a developing blade 42 and the like. The developing roller 32 is provided rotatably relative to the developing container 23. The magnet roller 34 is non-rotatably provided fixedly inside the developing roller 32. The developing blade 42 is a member for not only regulating a layer thickness of the toner T carried on the developing roller 32 but also triboelectrically charging the toner T.

In the developer container (toner container) 25, the toner T is accommodated, and the toner T is supplied to the developing device 20A. The toner container 25 includes a developer accommodating portion (hereinafter referred to as a toner chamber) 29 constituted by integrally assembling a container portion 21 and a cap 22 by a means such as welding. The toner container 25 includes a feeding member 43, rotatable about a feeding shaft (driven shaft) 101 inside the toner chamber 29, for feeding the toner T while stirring the toner T. The toner container 25 further includes a feeding gear 50 as a drive transmission member (drive transmitting means).

In this embodiment, the developing device 20A and the toner container 25 are connected with each other by integrally bonding the three members 21 to 23 consisting of the container portion 21 and the cap 22 which constitute the toner chamber 29 of the toner container 25 and the developing container 23 of the developing device 20A.

Image Forming Process

With reference to FIGS. 2 and 4, an outline of an image forming process of the image forming apparatus 100 will be described.

On the basis of a print start signal, the drum 62 is rotationally driven at a predetermined peripheral speed in an arrow R direction. An outer peripheral surface of the rotating drum 62 is electrically charged uniformly by the charging roller 66 to a predetermined polarity and a predetermined potential. The charging roller 66 contacts the drum 62 with a predetermined pressure and is rotated by rotation of the drum 62.

The exposure device 3 outputs laser light L modulated depending on image information. The laser light L passes through an exposure window portion 74 provided at an upper surface of the cartridge B, so that the outer peripheral surface of the drum 62 charged by the charging roller 66 is subjected to scanning exposure. As a result, on the outer peripheral surface of the drum 62, an electrostatic latent image depending on the image information is formed.

In the developing device 20, the feeding member 43 in the toner chamber 29 is rotationally driven in an arrow H direction at a predetermined speed. The feeding member 43 is rotationally driven, whereby the toner T in the toner chamber 29 is fed in a direction toward the developing container 23 including the developing roller 32 while being stirred, and thus the toner T is sent into the developing container 23 through a communication opening 27 between the toner chamber 29 and the developing container 23. That is, the toner T is supplied from the toner container 25 side to the developing device 20A side.

The developing roller 32 opposes the drum 62 with a predetermined small gap and is rotationally driven at a predetermined speed in an arrow K direction. The toner T fed from the toner chamber 29 to the developing container 23 is carried by a magnetic force of a magnet roller 34 (magnet), provided inside the developing roller 32, on a surface of the developing roller 32.

The toner T carried on the surface of the developing roller 32 is regulated in layer thickness by a developing blade 42 while being triboelectrically charged. The toner T is transferred onto the drum 62 depending on the electrostatic latent image at a developing portion M which is an opposing gap portion between the developing roller 32 and the drum 62, so that the electrostatic latent image is visualized (developed) as a toner image. The toner on the developing roller 32, which is not subjected to development of the latent image is returned and fed into the developing container 23 by further rotation of the developing roller 32.

On the other hand, in synchronism with output timing of the laser light L from the exposure device 9, by a pick-up roller 5*a*, one sheet material P stacked and accommodated in the sheet tray 4 is separated and fed. Then, the sheet material P is fed at predetermined control timing to a transfer position between the drum 62 and the transfer roller 7 by feeding roller 5*b*, 5*c* and a registration roller pair 5*d*, so that the toner image is successively transferred from the drum 62 onto the sheet material P.

The sheet material P on which the toner image is transferred is fed to the fixing device 9, where a pressure and heat-fixing process is effected. As a result, the toner image is fixed on the sheet material P. The sheet material P coming out of the fixing device 9 is discharged onto the discharge tray 11.

Mounting and Demounting of Process Cartridge

Figure 3:
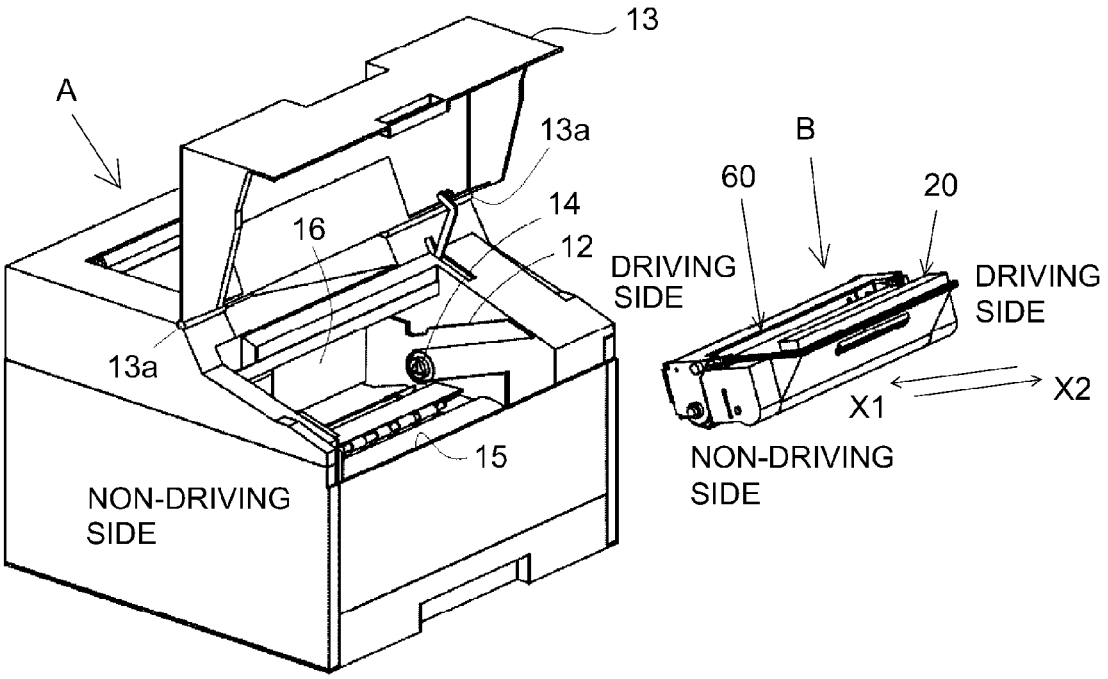
FIG. 3 is a perspective view of an apparatus main assembly for which an openable door is open and a process cartridge to be mounted therein.

Next, mounting and demounting of the cartridge B will be described with reference to FIG. 3. FIG. 3 is a perspective view of the apparatus main assembly A in a state in which an openable door 13 is open for mounting and demounting the cartridge B, and the cartridge B to be mounted and demounted.

To the apparatus main assembly A, the openable door 13 is mounted rotatably about a hinge portion 13*a* so as to be opened and closed. FIG. 2 shows a state in which the openable door 13 is closed. FIG. 3 shows a state in which the openable door 13 is open. When the openable door 13 is opened, a portion, corresponding to the openable door 13, of the apparatus main assembly A is largely opened as an opening 15. Then, in a state in which the cartridge B is not mounted, a cartridge mounting portion 16 in the apparatus main assembly A is in sight. Cartridge guide rails 12 for mounting and demounting the cartridge B are provided in a driving side and a non-driving side in a mirror symmetry manner. These guide rails 12 are inclined so as to descend frontward as seen from a mounting direction X1 of the cartridge B. As shown in FIG. 3, the opening 15 is largely opened by opening the openable door 13 of the apparatus main assembly A. A user or operator grips the developing apparatus 20 side of the cartridge B and then inserts the cartridge B into the cartridge mounting portion 16 through the opening 15 while the cleaning unit 60 side is in the front. Then, portions-to-be-engaged (not shown) of the cartridge B in the driving side and the non-driving side are moved along the guide rails 12 in the driving side and the non-driving side, respectively, so that the cartridge B is inserted in the cartridge mounting portion 16.

When the cartridge B is sufficiently inserted, the cartridge B is received by a stopper portion (not shown) and is prevented from being further inserted. In this state, the openable door 13 is closed. In the image forming apparatus in this embodiment, in interrelation with a closing operation of the openable door 13, a driving shaft 14 of the apparatus main assembly A in the driving side engages with a driving force-receiving portion (not shown) provided in the driving side of the cartridge B.

The driving shaft 14 is driven during execution of image formation by a motor (not shown) in the apparatus main assembly A side, so that a driving force of the driving shaft 14 is transmitted to the driving force-receiving portion engaging with the driving shaft 14. As a result, driven members such as the drum 62, the developing roller 32, the feeding member 43 and the like in the cartridge B side are driven. Further, electric power supplying contacts (not shown) of the apparatus main assembly A and electric power receiving contacts (not shown) of the cartridge B are electrically conducted, and thus to the charging roller 66 and the developing roller 32, electric power supply (predetermined bias (voltage) application) is made by an electric power supplying portion (not shown) of the apparatus main assembly A.

The demounting of the cartridge B mounted in the apparatus main assembly A is made by opening the openable door 13 to open the opening 15. In the image forming apparatus in this embodiment, in interrelation with an opening operation of the openable door 13, the driving shaft 14 in the apparatus main assembly A side moves from the driving force-receiving portion in the cartridge B side in a retracting (escaping) direction, so that connection between the driving shaft 14 and the driving force-receiving portion is eliminated (released). As a result, it becomes possible to demount the cartridge B from the apparatus main assembly A.

Then, the user grips the developing apparatus unit 20 side of the cartridge B exposed to the opening 15 and pulls and moves the cartridge B along the guide rails 12 in an opposite direction X2 to the mounting direction X1 of the cartridge B, so that the cartridge B is demounted from the cartridge mounting portion 16 to the outside of the image forming apparatus.

Here, with respect to the cartridge B in an unused fresh (new) state, as shown in (b) of FIG. 4, a communication opening 27 between a toner chamber 29 and the developing container 23 of the developing apparatus 20 is sealed by a removable sealing member 45. By this sealing member 45, the toner T filled in the toner chamber 29 is prevented from flowing into the developing container 23. The sealing member 45 prevents toner leakage from the cartridge B by maintaining the communication opening 27 in a sealed state during transportation of the cartridge B in the unused fresh state.

In the case where the cartridge B to be mounted in the apparatus main assembly A is in the unused fresh state during the mounting of the cartridge B, a removing operation of the sealing member 45 sealing the communication opening 27 in the developing apparatus unit 20. By removing the sealing member 45 to open the communication opening 27, so that the toner T can be supplied from the toner chamber 29 side into the developing container 23.

As a method of removing the sealing member 45, a method in which an end portion of the sealing member 45 is exposed to an outside of the developing apparatus 20 and then the user pulls and draws off the sealing member 45 is taken, for example. Alternatively, a method in which the sealing member 45 is peeled off by a winding-up mechanism provided inside the cartridge is taken.

Structure of Feeding Member

A structure of the feeding member 43 in the toner container 25 will be described using FIGS. 1 and 5. The feeding member 43 is constituted by a feeding shaft (driven shaft) 101 and a feeding sheet 102. In this embodiment, a constitution of the feeding member 43 consisting of the feeding shaft 101 and the feeding sheet 102 will be described, but the feeding member 43 may also have a constitution consisting of a single component having functions of the feeding shaft 101 and the feeding sheet 102 integrally assembled into a unit.

Figure 1:
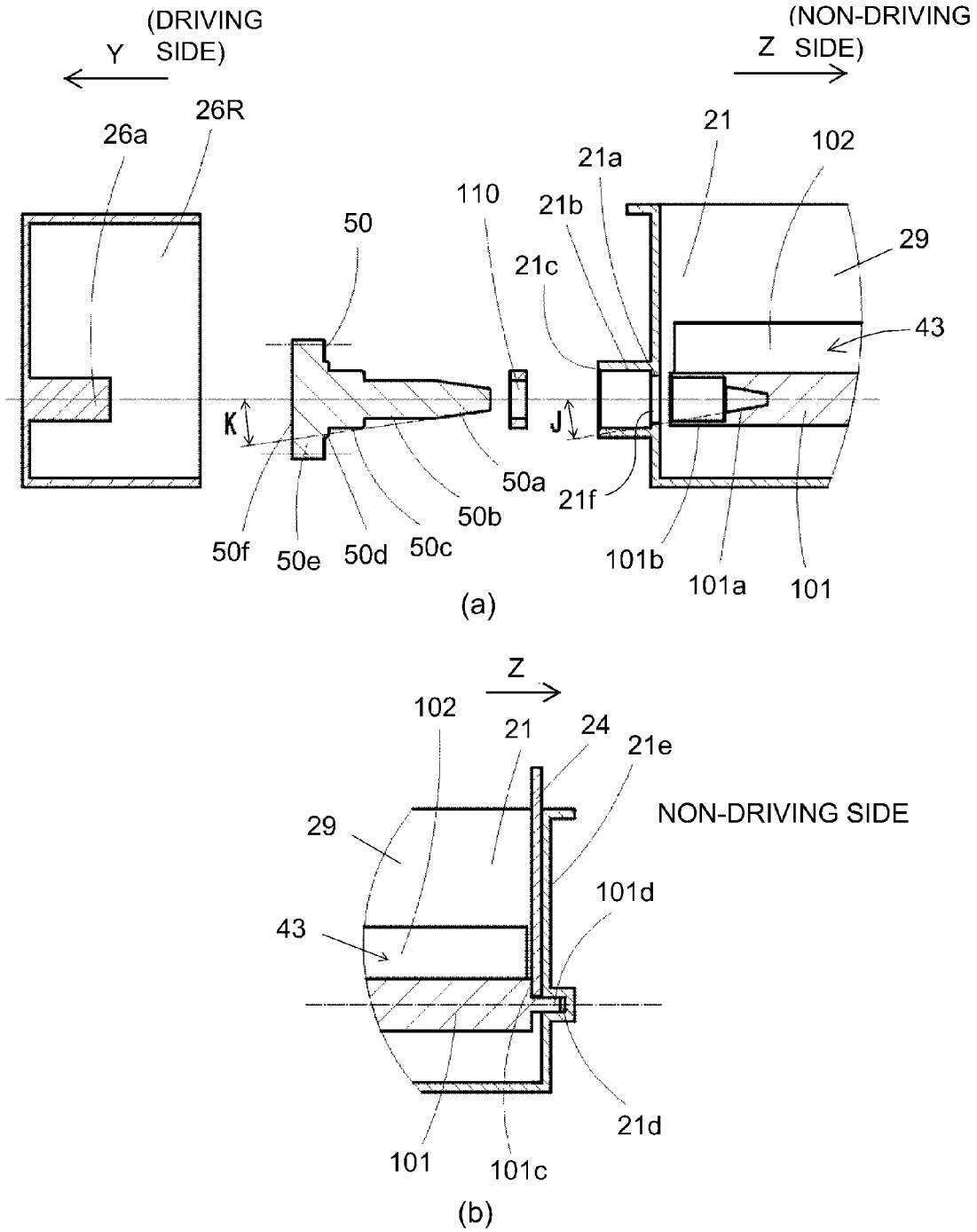
In FIG. 1, (a) and (b) are schematic sectional views showing a structure of a drive transmission member and a feeding member in Embodiment 1.

In the non-driving side of the feeding member 43, a non-driving side engaging shaft 101*d* ((b) of FIG. 1) of the feeding shaft 101 is engaged in a non-driving side engaging hole 21*d* of the container portion 21 constituting the toner chamber 29, and thus is rotatably supported by the container portion 21 inside the toner chamber 29. In the driving side of the feeding shaft 101, a feeding gear 50 as a drive transmission member is connected. The feeding gear 50 is rotatably mounted into the container portion 21. As a result, the feeding member 43 is rotationally driven by the feeding gear 50 in the toner chamber 29.

Further, as the feeding sheet 102, an elastic member is used and mounted on the feeding sheet 101 by a means such as thermal caulking. By rotating the feeding sheet 102 together with the feeding shaft 101, the toner T in the toner container 29 is fed to the developing roller 32 in the developing container 23.

Structure of Toner Container

A structure of the container portion 21 of the toner container 25 will be described using FIG. 1. In FIG. 1, (a) is an exploded sectional view of the toner container 25 in the driving side, in which cross-sections of the container portion 21 constituting the toner container 25, a driving side end portion of the feeding member 43, a feeding sealing member 110, the feeding gear 50 and the second side member 26R are shown. In FIG. 1, (b) shows a cross-section of a non-driving side end portion of the container portion 21.

In the driving side of the container portion 21, a driving side flange (first flange portion) 21*a* having a second hole 21*f*, a driving side engaging hole (third hole) 21*b* and a driving side end surface (end surface of the third hole 21*b*) 21*c* are provided. A diameter of the driving side engaging hole 21*b* is larger than a diameter of the second hole 21*f* of the driving side flange 21*a*. In the non-driving side of the container portion 21, the non-driving side engaging hole 21*d* and the non-driving side end surface 21*e* are provided.

Structure of Connecting Portion Between Feeding Gear and Feeding Shaft

A structure of connecting the feeding gear 50 and the feeding shaft 101 in the toner container 25 will be described using FIG. 1. The feeding gear 50 and the feeding shaft 101 in this embodiment are formed of mutually soluble (compatible) thermoplastic resin materials (polystyrene, ABS resin, polyoxymethylene and the like).

As shown in (a) of FIG. 1, the feeding gear includes:

1) a shaft side welding portion (projected bonding portion) 50*a* engaged in a hole side welding portion (recessed bonding portion) 101*a* of the feeding shaft 101, 2) a shaft (first shaft portion) 50*b* engaged in a hole (first hole) 101*b* of the feeding shaft 101 and a hole (second hole) of the flange portion (first flange portion) 21*a* of the container portion 29, 3) an engaging shaft (second shaft) 50*c* constituted in the driving side engaging hole (third hole) 21*b* of the container portion 29, 4) a flange portion (second flange portion) 50*d* opposing the end surface 21*c* of the driving side engaging hole 21*b*, and 5) a gear portion 50*e*, which are coaxially provided from a downstream side toward an upstream side in the listed order with respect to the inserting direction into the feeding shaft 101.

The shaft portion 50*b*, the engaging shaft 50*c* and the flange portion 50*d* have a cylindrical shape, and a size of a cross-sectional diameter is larger in the order of the flange portion 50*d*, the engaging shaft 50*c* and the shaft portion 50*b*. The shaft side welding portion 50*a* is a taper-shaped shaft. The gear portion 50*e* engages with a first gear 49 (FIG. 5) rotatably mounted on the container portion 21, so that drive transmission is made.

In this embodiment, the feeding shaft 101 is a solid square bar member in cross section. A size of the cross section thereof is such a size that it is possible to form the hole 101*b* in which the shaft portion 50*b* of the feeding gear 50 is engaged. A diameter of the flange portion 21*a* and an inner diameter of the driving side engaging hole 21*b* correspond to a diameter of the engaging shaft 50*c* of the feeding gear 50. A diameter of the flange portion 21*a* corresponds to a diameter of the shaft portion 50*b* of the feeding gear 50. A diameter of the end surface 21*c* of the driving side engaging hole 21*b* corresponds to a diameter of the flange portion 50*d* of the feeding gear 50.

A toner sealing member 110 is an elastic ring-shaped member, and an outer diameter thereof corresponds to an inner diameter of the driving side engaging hole 21*b*, and an inner diameter thereof corresponds to the diameter of the shaft portion 50*b*.

In FIG. 5, a developing roller gear 39 engages with a drum side gear (not shown) of the cleaning unit 60 to establish drive transmission, so that the developing roller 32 is rotationally driven. The developing roller gear 39 engages with the first gear 49 via the second gear 48 rotatably mounted on the toner accommodating container 21, so that the drive transmission to the gear portion 50*e* of the feeding gear 50 is made.

Structure of Feeding Shaft

A structure of the feeding shaft 101 will be described using FIG. 1. As shown in (a) of FIG. 1, at a driving side end portion of the feeding shaft 101, the hole side welding portion (recessed bonding portion) 101*a* and the hole (first hole) 101*b* which constitute a welding portion are provided coaxially in the listed order from the non-driving side. The hole side welding portion 101*a* is a taper-shaped hole, and the hole 101*b* is a cylinder-shaped hole. An angle K of the taper-shaped portion of the shaft side welding portion 50*a* of the feeding gear 50 is smaller than an angle J of the taper-shaped portion of the hole side welding portion 101*a* of the feeding shaft 101.

As shown in (b) of FIG. 1, at the non-driving side end portion of the feeding shaft 101, a cylinder-shaped non-driving side engaging shaft 101*d* and an abutment surface 101*c* are coaxially provided.

Connection Between Feeding Gear and Feeding Shaft

A connecting method of the feeding gear 50 and the feeding shaft 101 will be described using FIGS. 1 and 6. First, as shown in (a) of FIG. 1, in the driving side, the engaging shaft 50*c* of the feeding gear 50, the feeding sealing member 110, the driving side engaging hole 21*b* of the container portion 20, and the hole 101*b* of the feeding shaft 101 are coaxially held. Further, as shown in (b) of FIG. 1, in the non-driving side, the non-driving side engaging shaft 101*d* of the feeding shaft 101 and the non-driving side engaging hole 21*d* of the container portion 21 are coaxially held.

Figure 6:
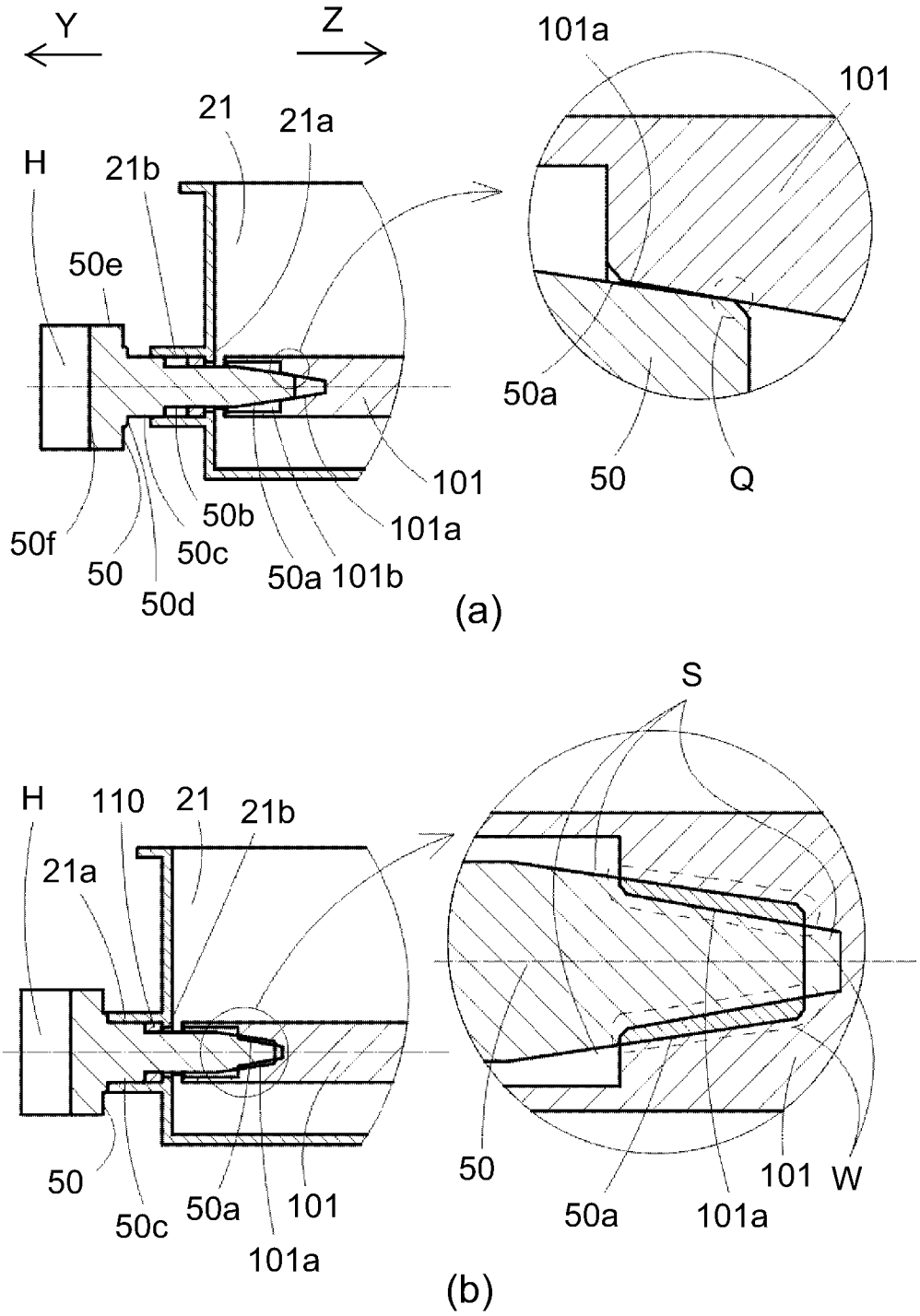
In FIG. 6, (a) and (b) are schematic views for illustrating an assembling method of the drive transmission member and the feeding member in Embodiment 1.

When the feeding gear 50 is inserted into the toner sealing member 110, the driving side engaging hole 21*b* and the hole 101*b* in the non-driving side direction Z, the non-driving side end portion of the shaft side welding portion 50*a* and the hole side welding portion 101*a* are in an abutment state at a point Q ((a) of FIG. 6). In FIG. 6, (a) shows a partly inserted state of the feeding gear 50 into the hole 101*b* of the feeding shaft 101.

At this time, as shown in FIG. 6, in the driving side, the engaging shaft 50*c* of the feeding gear 50 engages with the driving side engaging hole 21*b* of the container portion 21, so that the feeding gear 50 is positioned relative to the driving side engaging hole 21*b* with respect to a radial direction and is rotatably supported by the driving side engaging hole 21*b*.

Further, as shown in (b) of FIG. 1, in the non-driving side, the non-driving side engaging shaft 101*d* of the feeding shaft 101 engages with the non-driving side engaging hole 21*d* of the container portion 21, so that the feeding shaft 101 is positioned relative to the container portion 21 with respect to the radial direction. Further, an abutting member 24 is sandwiched between the abutment surface 101*c* of the feeding shaft 101 and the non-driving side end surface 21*e* of the container portion 21, so that movement of the feeding shaft 101 in a longitudinal direction of the feeding shaft 101 is limited.

As shown in (a) of FIG. 6, from this state, a welding horn H is contacted from the driving side to the end surface 50*f* of the feeding gear 50 and is pressed in the non-driving side direction Z while applying ultrasonic vibration. As a result, frictional heat due to the vibration generates at a contact portion between the hole side welding portion 101*a* and the shaft side welding portion 50*a*, so that the resin material melts. The feeding gear 50 moves further in the non-driving side direction Z while the resin material at the contact portion melts, so that the flange portion 50*d* of the feeding gear 50 contacts the driving side flange 21*a* of the toner accommodating container 21 and is inserted to a position of (b) of FIG. 6.

In FIG. 6, (b) is a sectional view showing a state in which the feeding gear 50 and the feeding shaft 101 are welded and connected with each other. As shown in (b) of FIG. 6, a space S is created at this time between the non-driving side surface of the hole side welding portion 101*a* and the non-driving side free end surface of the shaft side welding portion 50*a* and between the hole 101*b* and the welding portion 50*a* and the shaft 50*b*. A part of the melted resin material is extruded into the space S with the insertion of the feeding gear 50. In this way, by providing the space S, it is possible to suppress deformation of the feeding gear 50 and the feeding shaft 101 due to application of excessive force to the feeding gear 50 and the feeding shaft 101 during welding.

Finally, the feeding gear 50 and the feeding shaft 101 are welded and connected with each other at the shaft side welding portion 50*a* and the hole side welding portion 101*a* in a welding region W as indicated by broken lines in (b) of FIG. 6. That is, the feeding shaft 101 and the feeding gear 50 as the drive transmission member are welded with (bonded to) each other at an engaging portion 101*a*, 50*a*. Incidentally, in (b) of FIG. 6, for convenience of explanation, the shaft side welding portion 50*a* and the hole side welding portion 101*a* are illustrated in a superposed state, but in actually, those portions are integrally constituted.

In this state, by pulling out the abutting member 24, the feeding shaft 101 is provided rotatably relative to the toner accommodating container 21. Further, the second side member 26R (FIG. 1) is fixed on the toner accommodating container 21 in the driving side by using a screw 92 (FIG. 5), so that the movement of the feeding gear 50 toward the driving side is limited by a longitudinal limiting base 26*a* (FIG. 1) provided in the second side member 26R.

Even when polyoxymethylene having a poor adhesive property is used as the material for the feeding gear 50 and the feeding shaft 101, by employing the constitution and the connecting method as in this embodiment, it is possible to provide the integral component.

The feeding sealing member 110 is engaged in the driving side engaging hole 21*b* of the toner accommodating container 21, and the longitudinal position thereof is between the driving side flange 21*a* of the toner accommodating container 21 and the engaging shaft 50*c* of the feeding gear 50. In this way, by providing the feeding sealing member 110, it is possible to prevent leakage of the toner T in the toner accommodating container 21 to the outside through the driving side engaging hole 21*b*.

As described above, the feeding gear 50 and the feeding shaft 101 are welded with each other through full circumference of the welding region (bonding portion) W at the engaging portion, whereby when the feeding gear 50 is rotationally driven, the driving force is transmitted from the feeding gear 50 to the feeding shaft 101 in an entirety of the welding region W. As a result, it is possible to avoid concentration of stress of the connecting portion between the feeding gear 50 and the feeding shaft 101 at a single point, so that strength between the feeding gear 50 and the feeding shaft 101 is improved.

Further, even when a material, such as polyoxymethylene, having a poor adhesive property is used as the material for the feeding gear 50 and the feeding shaft 101, the shaft side welding portion 50*a* and the hole side welding portion 101*a* are welded with each other, so that the feeding gear 50 and the feeding shaft 101 can be connected with each other.

Embodiment 2

Embodiment 2 of the present invention will be described using FIG. 7. In the following description, members having the same functions as those of the members in Embodiment 1 are represented by the same reference numerals or symbols. Constitutions similar to those in Embodiment 1 will be omitted from description.

Figure 7:
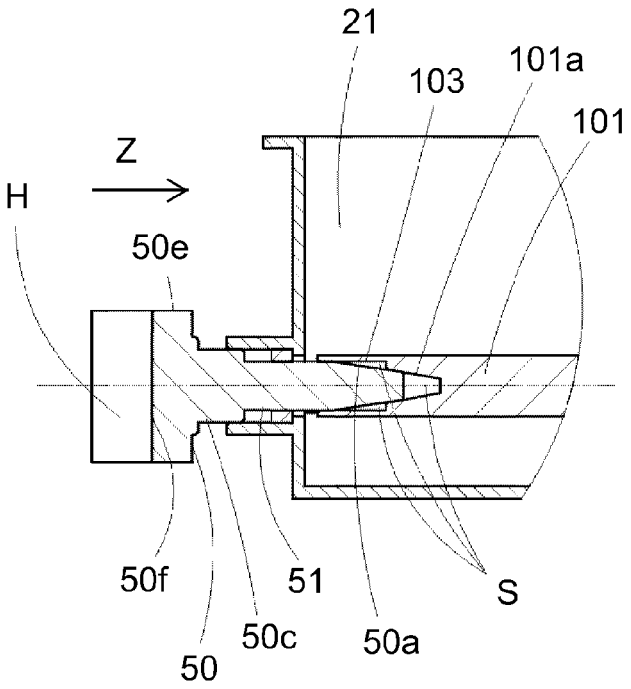
FIG. 7 is a schematic view for illustrating an assembling method of a drive transmission member and a feeding member in Embodiment 2.

FIG. 7 shows a partly inserted state of the shaft side welding portion 50*a* of the feeding gear 50 into the hole side welding portion 101*a* of the feeding shaft 101. A feature of Embodiment 2 is that between the shaft side welding portion 50*a* and the engaging shaft 50*c* with respect to the longitudinal direction of the feeding gear 50, a welding engaging shaft 51 as an engaging portion is provided, and at a driving side end portion of the feeding shaft 101, a welding engaging hole 103 as an engaging portion is provided. That is, the feeding shaft 101 includes the second engaging portion 103 engaging with the part 51 of the feeding gear 50 in the neighborhood of the welding region (bonding portion) with the feeding gear 50.

As shown in FIG. 7, in the driving side, the welding engaging shaft 51 of the feeding gear 50 engages with the welding engaging hole 103 of the feeding shaft 101, so that the position of the feeding shaft 101 is determined relative to the welding engaging shaft 51 of the feeding gear 50 with respect to the radial direction. In the non-driving side, similarly as in Embodiment 1, the non-driving side engaging shaft 101*d* of the feeding shaft 101 engages with the non-driving side engaging hole 21*d* of the toner accommodating container 21, so that the position of the feeding shaft 101 is determined relative to the toner accommodating container 21 with respect to the radial direction ((b) of FIG. 1).

As shown in FIG. 7, the weld horn H is contacted to the end surface 50*f* of the feeding gear 50 in this state, and is pressed in the non-driving side direction Z while applying ultrasonic vibration to the feeding gear 50. At this time, in the state in which the positions of the feeding gear 50 and the feeding shaft 101 are determined with respect to the radial direction, the shaft side welding portion 50*a* and the hole side welding portion 101*a* can be welded with each other, so that the positions of the feeding gear 50 and the feeding shaft 101 do not shift in the radial direction.

In this way, in this embodiment, the shaft side welding portion 50*a* and the hole side welding portion 101*a* are provided toward the non-driving side than the engaging position between the welding engaging hole 103 and the weld engaging shaft 51. A gap between the welding engaging hole 103 and the welding engaging shaft 51 at the engaging portion with respect to the radial direction is very small, and therefore the melted resin material generating during the welding does not pass through the engaging portion to reach the inside of the toner accommodating container 21.

As described above, the feeding shaft 101 includes the engaging portion 103 engaging with the part 51 of the feeding gear 50 in the neighborhood of the welding portion (bonding portion) W of the feeding gear 50. By employing this constitution, the feeding gear 50 can be connected with the welding engaging hole 103 of the feeding shaft 101 with high accuracy, so that inclination of the feeding shaft 101 in each of the driving side and the non-driving side can be suppressed. A deviation in toner feeding property due to the inclination of the feeding shaft 101 in each of the driving side and the non-driving side can be suppressed, so that a density of an output image can be made uniform.

Embodiment 3

The connection of the feeding shaft 101 and the feeding gear 50 at the engaging portion is not limited to the welding as in Embodiments 1 and 2. It is possible to connect the feeding shaft 101 and the feeding gear 50 by bonding with use of an adhesive.

Figure 8:
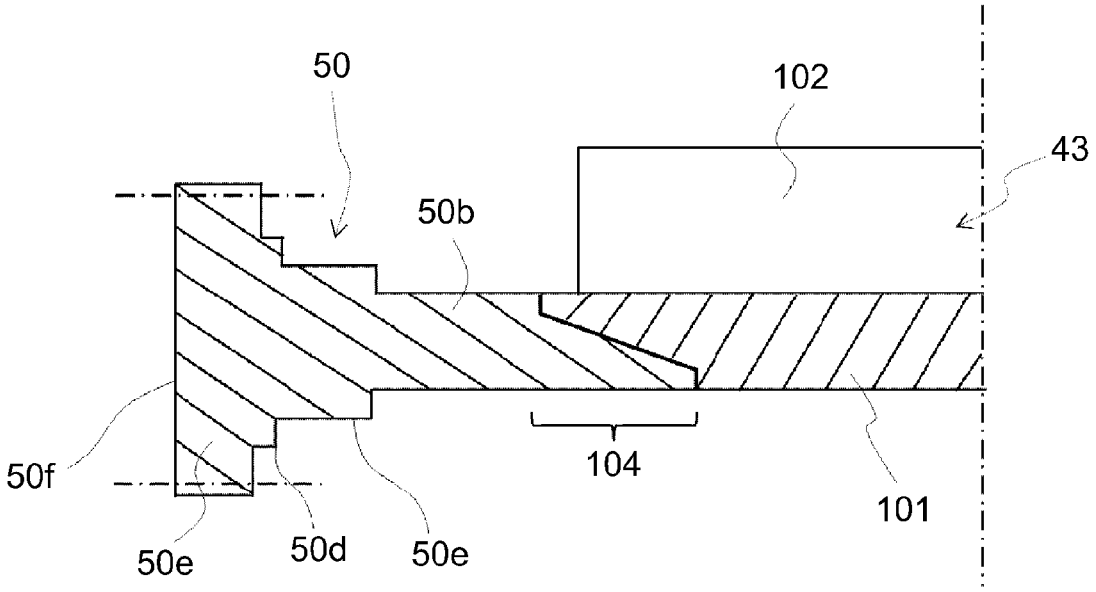
FIG. 8 is an illustration of Embodiment 3.

The engaging state of the engaging portion between the feeding shaft 101 and the feeding gear 50 is not limited to the engaging state between the feeding gear 50 as a projected portion and the feeding shaft 101 as a recessed portion. Reversely, it is also possible to use an engaging state between the feeding gear 50 as the recessed portion and the feeding shaft as the projected portion. Further, for example, as shown in FIG. 8, a constitution in which the feeding shaft 101 and the feeding gear 50 are connected with each other at an engaging portion 104 having a symmetrical combination joint structure, and then the resultant connecting portion is welded or bonded using the adhesive can also be employed.

Embodiment 4

In Embodiments 1 to 3, the toner container 25 may also be constituted as a developer container (toner cartridge) detachably mountable to the developing device 20A. In the case of the developer container, the image bearing member is mounted in the apparatus main assembly A or on the cartridge supporting member. Alternatively, the image bearing member is provided in the process cartridge of the so-called function separation type. In this case, the process cartridge does not include the developing means.

Further, a constitution in which the developing device 20A and the toner container 25 are integrally assembled into a developing apparatus cartridge (developing cartridge) detachably mountable to the apparatus main assembly A may also be employed.

Further, the toner container 25 may also be a residual toner container for collecting residual toner removed from the outer peripheral surface of the drum 62. That is, the toner container 25 may also be constituted as a residual developer accommodating container for collecting the residual toner (residual developer) removed from the surface of the drum 62 to which the toner T is supplied. At this time, at a connecting portion of a residual toner feeding means for feeding the residual toner toward a rear side of the residual toner container and a residual toner gear for driving the residual toner feeding means, the constitution and the connecting method at the connecting portion between the feeding gear 50 and the feeding shaft 101 as in each of Embodiments 1 to 3 can be used.

Other Embodiments (2) The type of the image bearing member 62 is not limited to the drum type. The image bearing member 62 can be of a flexible endless belt type.

(3) The developing type of the developing device 20 is not limited to the developing type using the one-component magnetic developer. The developing type may also be a developing type using a one-component non-magnetic developer or a developing type using a so-called two-component developer.

(4) The image forming principle and the image forming process of the image forming portion of the image forming apparatus are not limited to the electrophotographic process. The process may also be an electrostatic recording process using a dielectric member as the image bearing member, a magnetic recording process using a magnetic member as the image bearing member, and the like process. The image forming apparatus is not of the transfer type, but may also be a direct type in which photosensitive paper (electrofacsimile paper) or electrostatic recording paper is used as the recording material (image bearing member) and the image is directly formed on the recording material.

According to the present invention, it is possible to provide a developing container capable of reducing a degree of stagnation of the developer at the lower portion of stress concentration at connecting portion between the feeding member and the drive transmission member. It is also possible to provide a developing apparatus including the developer container. It is also possible to provide a process cartridge including the developing container. It is further possible to provide an image forming apparatus using the developing container or the process cartridge.

While the invention has been described with reference to the structures disclosed herein, it is not confined to the details set forth and this application is intended to cover such modifications or changes as may come within the purpose of the improvements or the scope of the following claims.

This application claims the benefit of Japanese Patent Applications Nos. 2014-179994 filed on Sep. 4, 2014 and 2015-160538 filed on Aug. 17, 2015, which are hereby incorporated by reference herein in their entirety.

What is claimed is:

1. A developer container comprising:

a developer accommodating container for accommodating developer;

a feeding member for feeding the developer, said feeding member being formed of a resin material and being rotatable about an axis of a feeding shaft inside said developer accommodating container; and a drive transmission member that is formed of a resin material and is rotatably mounted to said developer accommodating container, wherein a taper-shaped hole of said feeding shaft and a taper-shaped shaft of said drive transmission member are welded to each other.

2. The developer container according to claim 1, wherein said feeding shaft includes an engaging portion with a part of said drive transmission member in a neighborhood of a bonding portion to said drive transmission member.

3. The developer container according to claim 1, wherein said feeding shaft and said drive transmission member are welded to each other by melting a part of said feeding shaft and said drive transmission member.

4. The developer container according to claim 1, wherein said drive transmission member includes:

i) a projected bonding portion engaged in a recessed bonding portion of said feeding shaft, ii) a first shaft engaged in a first hole of said feeding shaft and a second hole of a first flange portion of said developer accommodating container, iii) a second shaft engaged in a third hole of said developer accommodating container, iv) a second flange portion opposing an end surface of the third hole, and v) a gear portion, which are coaxially provided from a downstream side toward an upstream side in the listed order with respect to an inserting direction into said feeding shaft.

5. The developer container according to claim 4, wherein said first shaft, said second shaft, and said second flange portion have a cylindrical shape, and a size of a cross sectional diameter is larger in the order of said second flange, said second shaft, and said first shaft, and wherein said projected bonding portion is said taper-shaped shaft.

6. The developer container according to claim 5, wherein said recessed bonding portion is said taper-shaped hole in which said taper-shaped shaft as said projected bonding portion is engaged, and an angle of taper-shaped shaft as said projected bonding portion is smaller than an angle of said taper-shaped hole as said recessed bonding portion.

7. The developer container according to claim 1, which is a container for supplying the developer to a developing device including a developer carrying member for carrying the developer and for developing a latent image formed on an image bearing member.

8. The developer container according to claim 7, wherein said developer container is detachably mountable to said developing device.

9. The developer container according to claim 1, which is a container for accommodating residual developer removed from an image bearing member to which the developer is supplied.

10. The developer container according to claim 1, wherein said feeding shaft and said drive transmission member are bonded to each other by applying ultrasonic vibration.

11. A developing apparatus for developing with developer a latent image formed on an image bearing member, said developing apparatus comprising:

a developing device including a developer carrying member for carrying the developer and for developing the latent image formed on the image bearing member; and a container for supplying the developer to said developing device, wherein said container is a developer container comprising:

a developer accommodating container for accommodating developer, a feeding member for feeding the developer, said feeding member being formed of a resin material and being rotatable about an axis of a feeding shaft inside said developer accommodating container; and a drive transmission member that is formed of a resin material and is rotatably mounted to said developer accommodating container, wherein a taper-shaped hole of said feeding shaft and a taper-shaped shaft of said drive transmission member are welded to each other.

12. A process cartridge detachably mountable to a main assembly of an image forming apparatus, said process cartridge comprising:

a rotatable image bearing member on which a latent image is formed;

a developing device including a developer carrying member for carrying developer and for developing the latent image formed on said image bearing member; and a container for supplying the developer to said developing device, wherein said container is a developer container comprises:

a developer accommodating container for accommodating developer, a feeding member for feeding the developer, said feeding member being formed of a resin material and being rotatable about an axis of a feeding shaft inside said developer accommodating container; and a drive transmission member that is formed of a resin material and is rotatably mounted to said developer accommodating container, wherein a taper-shaped hole of said feeding shaft and a taper-shaped shaft of said drive transmission member are welded to each other.

13. The process cartridge according to claim 12, wherein said image bearing member is an electrophotographic photosensitive member of a drum type or an endless belt type.

14. An image forming apparatus for forming an image on a recording material, said image forming apparatus comprising:

a rotatable image bearing member on which a latent image is formed;

a developing device including a developer carrying member for carrying developer and for developing the latent image formed on said image bearing member; and a container for supplying the developer to said developing device, wherein said container is a developer container comprising:

a developer accommodating container for accommodating developer, a feeding member for feeding the developer, said feeding member being formed of a resin material and being rotatable about an axis of a feeding shaft inside said developer accommodating container; and a drive transmission member that is formed of a resin material and is rotatably mounted to said developer accommodating container, wherein a taper-shaped hole of said feeding shaft and a taper-shaped shaft of said drive transmission member are welded to each other.

15. The image forming apparatus according to claim 14, wherein said developer container is constituted as a developer cartridge detachably mountable to a main assembly of said image forming apparatus.

16. The image forming apparatus according to claim 14, wherein said developing device and said developer container are constituted as a developing cartridge detachably mountable to a main assembly of said image forming apparatus.

17. The image forming apparatus according to claim 14, wherein at least said image bearing member, said developing device, and said developer container are constituted as a process cartridge detachably mountable to a main assembly of said image forming apparatus.

18. The image forming apparatus according to claim 14, wherein said image bearing member is an electrophotographic photosensitive member of a drum type of an endless belt type.

* * * * *